US010486867B2

(12) United States Patent
Graybill et al.

(10) Patent No.: US 10,486,867 B2
(45) Date of Patent: Nov. 26, 2019

(54) CLOSURE SYSTEM FOR CONTAINER

(71) Applicant: AMCOR RIGID PLASTICS USA, LLC, Wilmington, DE (US)

(72) Inventors: Myles Graybill, South Lyon, MI (US); Jonathan P. Jarman, Ann Arbor, MI (US)

(73) Assignee: AMCOR RIGID PLASTICS USA, LLC, Wilmington, DE (US)

( * ) Notice: Subject to any disclaimer, the term of this patent is extended or adjusted under 35 U.S.C. 154(b) by 0 days.

(21) Appl. No.: 15/762,315

(22) PCT Filed: Sep. 21, 2016

(86) PCT No.: PCT/US2016/052873
§ 371 (c)(1),
(2) Date: Mar. 22, 2018

(87) PCT Pub. No.: WO2017/053419
PCT Pub. Date: Mar. 30, 2017

(65) Prior Publication Data

US 2018/0265264 A1 Sep. 20, 2018

Related U.S. Application Data

(60) Provisional application No. 62/232,501, filed on Sep. 25, 2015.

(51) Int. Cl.
*B65D 47/04* (2006.01)
*B65D 41/04* (2006.01)
(Continued)

(52) U.S. Cl.
CPC ..... *B65D 47/043* (2013.01); *B65D 1/0207* (2013.01); *B65D 41/04* (2013.01);
(Continued)

(58) Field of Classification Search
CPC ..... B65D 55/02; B65D 51/20; B65D 47/02; B65D 47/043
(Continued)

(56) References Cited

U.S. PATENT DOCUMENTS 5,107,998 A * 4/1992 Zumbuhl ..... B65D 41/3428 215/252
5,131,549 A * 7/1992 Battegazzore ..... B65D 41/3419 215/252
(Continued)

FOREIGN PATENT DOCUMENTS

WO WO-2010125595 A1 * 11/2010 ..... B65D 49/04

OTHER PUBLICATIONS

International Search Report and Written Opinion issued in PCT/US2016/052873, dated Dec. 28, 2016; ISA/KR.

*Primary Examiner* — J. Gregory Pickett
*Assistant Examiner* — Tia Cox
(74) *Attorney, Agent, or Firm* — Harness, Dickey & Pierce, P.L.C.

(57) ABSTRACT

A closure system for a container. The system includes a closure configured to couple with a finish of the container to close an opening of the container defined by the finish. A tamper ring is removably attached to the closure. Upon removing the closure from cooperation with the finish of the container, the tamper ring detaches from the closure and remains on a neck of the container.

21 Claims, 7 Drawing Sheets

(51) Int. Cl.
*B65D 43/02* (2006.01)
*B65D 85/72* (2006.01)
*B65D 1/02* (2006.01)
*B65D 41/34* (2006.01)

(52) U.S. Cl.
CPC ..... *B65D 41/3423* (2013.01); *B65D 41/3428* (2013.01); *B65D 43/02* (2013.01); *B65D 85/72* (2013.01)

(58) Field of Classification Search
USPC ..... 215/45, 354, 364, 43, 70, 211, 252, 250, 215/330, 256, 358, 355; 220/288, 304; 425/385
See application file for complete search history.

(56) References Cited

U.S. PATENT DOCUMENTS 5,556,008 A * 9/1996 Silver ..... A61J 7/0023 215/DIG. 5
6,382,444 B1 5/2002 Nyman
6,845,887 B1 * 1/2005 Granger ..... B65D 47/043 222/153.06
2004/0060891 A1 * 4/2004 Nishida ..... B65D 41/3438 215/252
2004/0217083 A1 * 11/2004 Mavin ..... B65D 47/103 215/253
2007/0017830 A1 * 1/2007 Neumeyer ..... B65D 51/2835 206/219
2007/0023380 A1 * 2/2007 Shingle et al. .... B65D 41/0421 215/217
2009/0236544 A1 * 9/2009 Sturgeon ..... G01N 21/3103 250/492.1
2009/0250469 A1 10/2009 Heiberger
2010/0018942 A1 1/2010 Battegazzore
2013/0200036 A1 * 8/2013 Delage ..... B65D 41/005 215/344
2014/0076838 A1 * 3/2014 Siegi ..... B29C 49/06 215/44
2016/0016681 A1 * 1/2016 Heyn ..... B65D 41/045 53/471
2017/0066564 A1 * 3/2017 Walsh ..... B65D 39/08

* cited by examiner

CLOSURE SYSTEM FOR CONTAINER

CROSS REFERENCE TO RELATED APPLICATIONS

This application is a U.S. National Phase Application under 35 U.S.C. 371 of International Application No. PCT/US2016/052873 filed on Sep. 21, 2016 and published in English as WO 2017/053419 A1 on Mar. 30, 2017. This application claims the benefit of U.S. Provisional Application No. 62/232,501, filed on Sep. 25, 2015. The entire disclosures of the above applications are incorporated herein by reference.

FIELD

The present disclosure relates to a closure system for a container.

BACKGROUND

This section provides background information related to the present disclosure, which is not necessarily prior art.

As a result of environmental and other concerns, plastic containers, more specifically polyester and even more specifically polyethylene terephthalate (PET) containers, are being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. While current containers, container closures, and pouring inserts are suitable for their intended use, they are subject to improvement. For example, current pouring inserts are often installed by a purchaser after opening the container. Such pouring inserts are inserted within the opening of the container to facilitate pouring. In some instances, a pouring insert may be installed at the bottler in a multi-part operation, which is time consuming and increases the expense of the container. For example, first the container is filled, then the pouring insert is attached to the container, and then a closure is attached over the pouring insert to close and seal the container. The present teachings provide an improved closure assembly for a container that addresses deficiencies in the art, and provides numerous advantages.

SUMMARY

This section provides a general summary of the disclosure, and is not a comprehensive disclosure of its full scope or all of its features.

The present teachings provide for a closure system for a container. The system includes a closure configured to couple with a finish of the container to close an opening of the container defined by the finish. A tamper ring and an insert are removably attached to the closure. Upon removing the closure from cooperation with the finish of the container, the tamper ring and the insert detach from the closure and remain on a neck of the container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
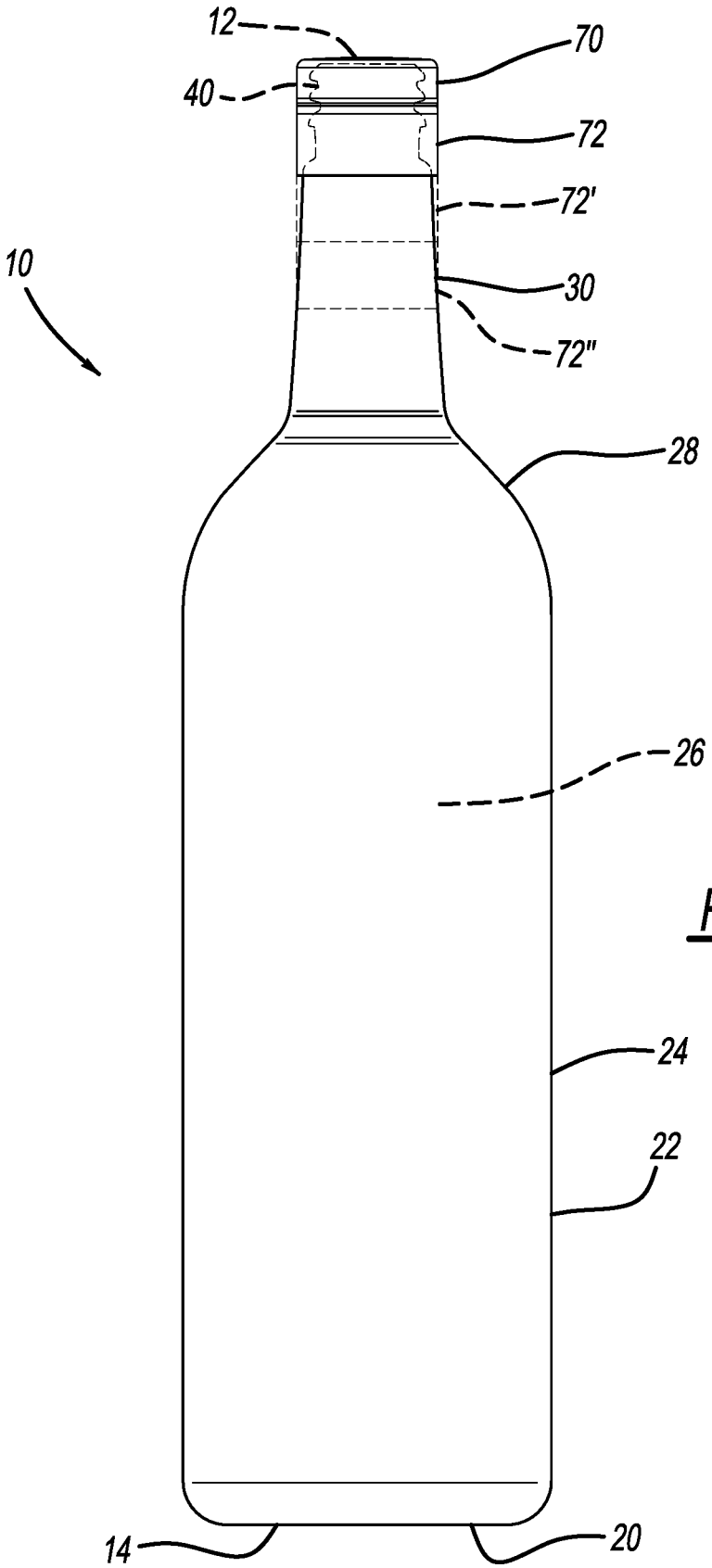
FIG. 1 is a side view of a container including a closure and insert according to the present teachings.

With initial reference to FIG. 1, an exemplary container according to the present teachings is illustrated at reference numeral 10. The container 10 can have any suitable size and any suitable shape. The size and shape of the exemplary container 10 illustrated is typical of containers for wine and spirits, but the container 10 can be configured to store any suitable contents. The container 10 can be made of any suitable material, such as glass or any suitable polymer. Suitable polymers include, but are not limited to, polyethylene terephthalate (PET) or any other suitable polymer. The container 10 can be formed in any suitable manner, such as by injection blow-molding from a polymeric preform.

In the example illustrated, the container 10 includes a first end 12 and a second end 14, which is opposite to the first end 12. The first and second ends 12 and 14 are at opposite ends of the container 10, and are generally aligned along a longitudinal axis of the container 10. At the second end 14 is a base 20 of the container 10. The base 20 can be configured in any suitable manner so as to support the container 10 upright when the container 10 is seated on a flat or generally flat surface.

Extending from the base 20 is a body 22 of the container 10, which is defined by a sidewall 24. The sidewall 24 is generally cylindrical in the example illustrated, but may have any other suitable shape. For example, the sidewall 24 may be oval, and may include a plurality of sidewalls to provide a plurality of shapes, such as square, rectangular, triangular, or any other suitable shape. The sidewall 24 defines at least a portion of an inner volume 26 of the container 10. The inner volume 26 is configured to store the contents of the container 10 therein, such as wine or spirits, for example.

Extending from the body 22 towards the first end 12 is a shoulder 28 of the container 10. The shoulder 28 generally tapers inward as the shoulder 28 extends towards the first end 12. The shoulder 28 is generally an extension of the sidewall 24. The shoulder 28 tapers inward to a neck 30 of the container 10. The neck 30 extends away from the shoulder 28 to a finish 40 of the container 10. The neck 30 may taper inward as it extends away from the shoulder 28 to the finish 40, or may extend linearly along the longitudinal axis of the container 10.

Figure 2:
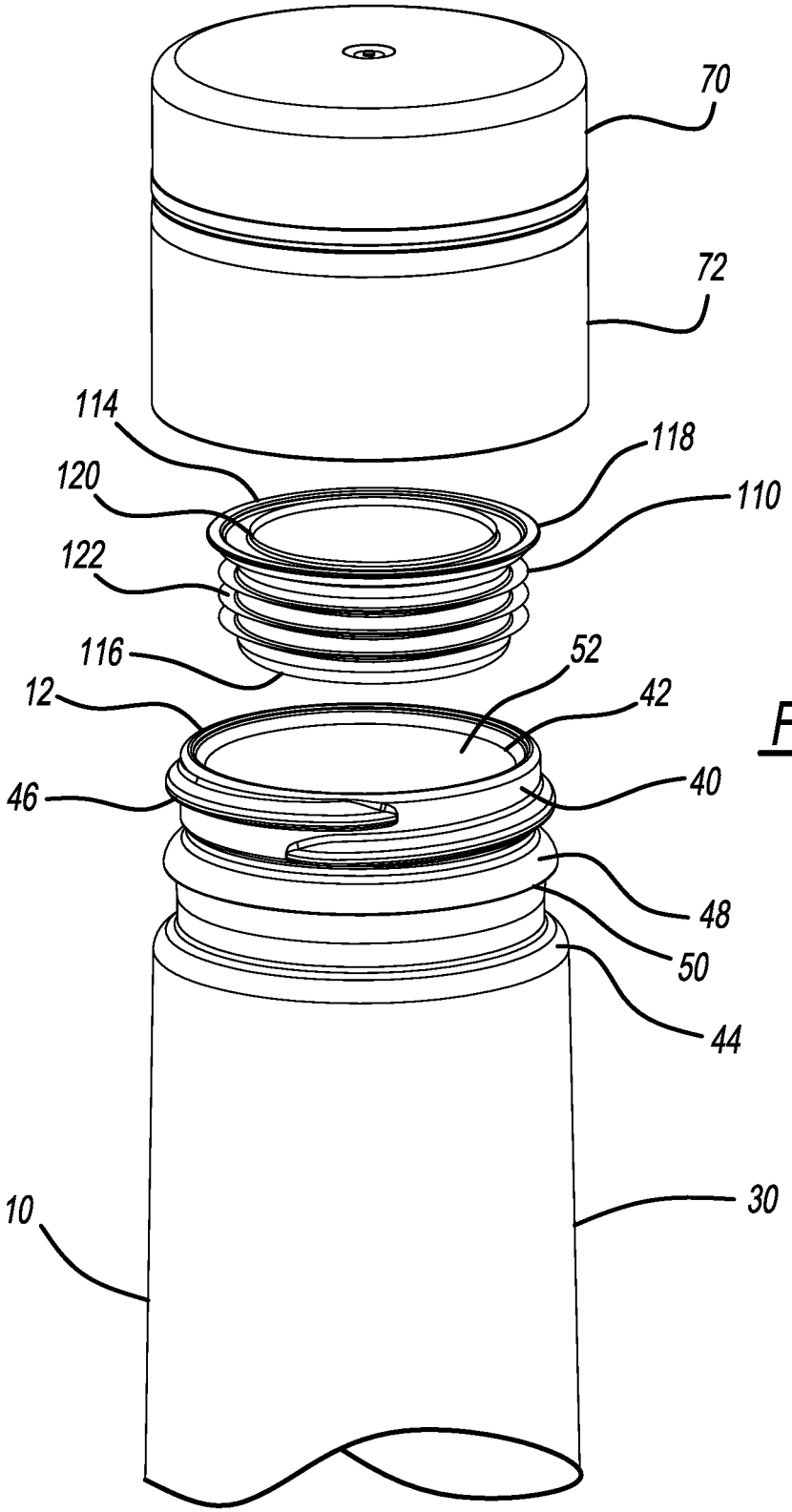
FIG. 2 is a perspective view of the closure, a finish of the container, and an insert or fitment according to the present teachings.

With continued reference to FIG. 1, and additional reference to FIG. 2, the finish 40 defines an opening 42 of the container 10. The opening 42 provides access to the inner volume 26 in order to fill the container 10, as well as to pour contents of the container 10 out from within the inner volume 26. The finish 40 includes a ridge or flange 44 where the finish 40 generally transitions to the neck 30. Proximate to the opening 42, the finish 40 includes threads 46 at an outer surface thereof, which are configured to cooperate with any suitable closure, such as closure 70 according to the present teachings (described further herein). Between the threads 46 and the ridge or flange 44 is a tamper bead 48. The tamper bead 48 extends about the finish 40 from an outer surface thereof. On a side of the tamper bead 48 facing the ridge or flange 44, the tamper bead 48 has a generally planar surface, which will be described further herein, such as in conjunction with the description of FIG. 6. The finish 40 can be formed in any suitable manner, such as by injection or blow molding, and can include the tamper bead 48 regardless of whether the finish 40 is injection molded or blow molded.

Figure 3A:
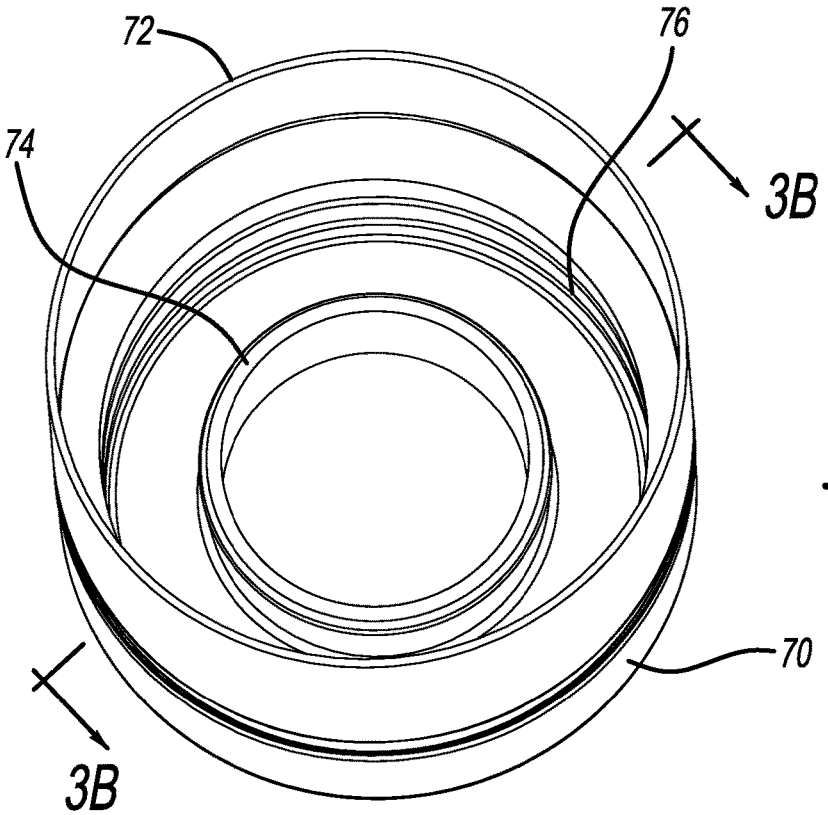
FIG. 3A is a perspective view of an inner portion of the closure.
Figure 3B:
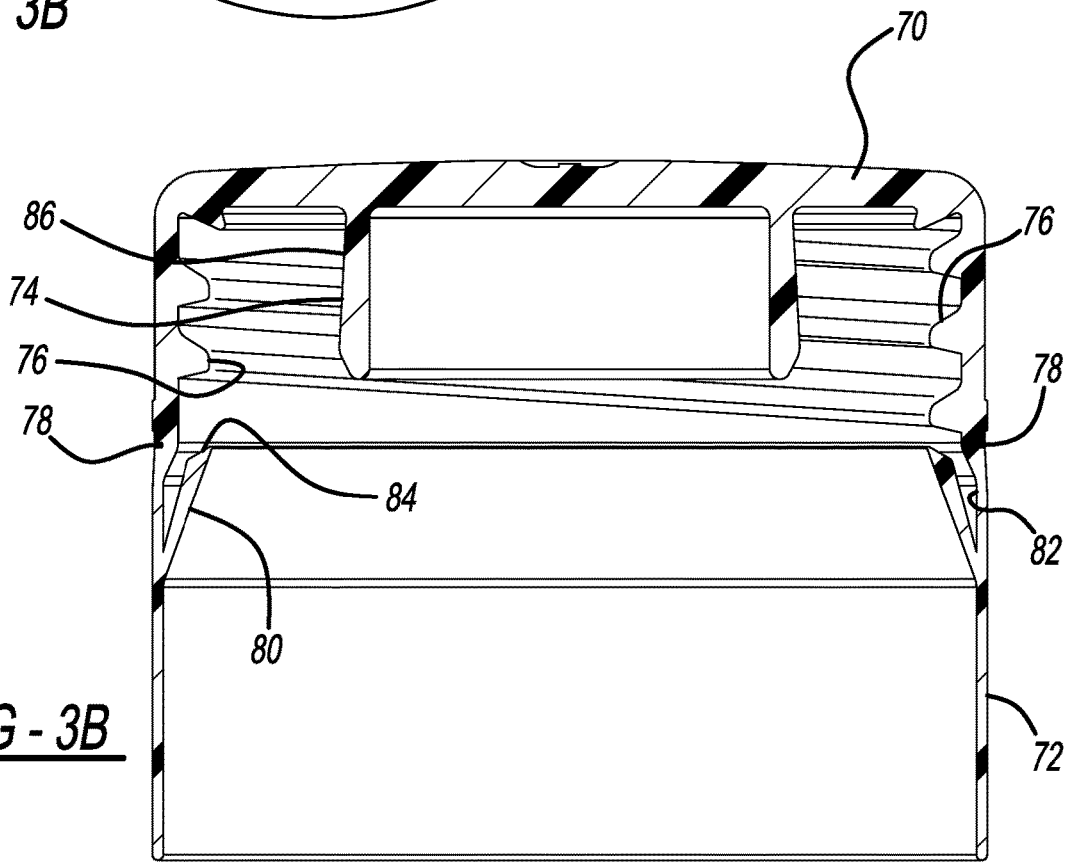
FIG. 3B is a cross-sectional view taken along line 3B-3B of FIG. 3A.

With continued reference to FIGS. 1 and 2, and additional reference to FIGS. 3A and 3B, the present teachings provide for closure 70 for closing the opening 42 of the container 10. The closure 70 is connected to a tamper ring 72. The closure 70 generally includes, with particular reference to FIGS. 3A and 3B, an internal flange 74. The internal flange 74 is generally an annular flange extending from an inner surface of the closure 70. The internal flange 74 is sized and shaped to cooperate and mate with insert 110, as described further herein. The closure 70 further includes internal threads 76, which are configured to cooperate with the threads 46 of the finish 40 in order to secure the closure 70 to the container 10.

The tamper ring 72 is removably coupled to the closure 70 with any suitable coupling 78. For example, the coupling 78 can be a perforated area configured to break and separate the closure 70 and the tamper ring 72 when the closure 70 is unscrewed form the finish 40, as explained further herein. The tamper ring 72 extends away from the closure 70 and can have any suitable length. For example, the tamper ring 72 can have a length suitable to extend a desired distance along the neck 30 towards the shoulder 28. With reference to FIG. 1, the tamper ring 72 can have a first, relatively short length. The tamper ring 72' can have a second, intermediate length. The tamper ring 72" can have a third, relatively longer length, or any other suitable length. The tamper ring 72 advantageously provides the appearance of a roll-on pilfer proof (ROPP) closure that can accommodate containers having an elongated neck 30, as often found with wine bottles and spirits bottles.

The tamper ring 72 includes an inner tab 80, which is generally an annular tab that extends from an inner wall 82 of the tamper ring 72 towards the coupling 78. The inner tab 80 extends inward as it extends toward the coupling 78 such that a distal portion 84 of the inner tab 80 is spaced apart from the inner wall 82 of the tamper ring 72. The inner tab 80 is generally flexible and is configured to be positioned below the generally planar surface 50 of the tamper bead 48 (of the finish 40) in order to retain the tamper ring 72 on the container 10 after the closure 70 has been removed, as explained further herein. The closure 70 and the tamper ring 72 can be made of any suitable material, such as polypropylene (PP) or high density polyethylene (HD).

Figure 4A:
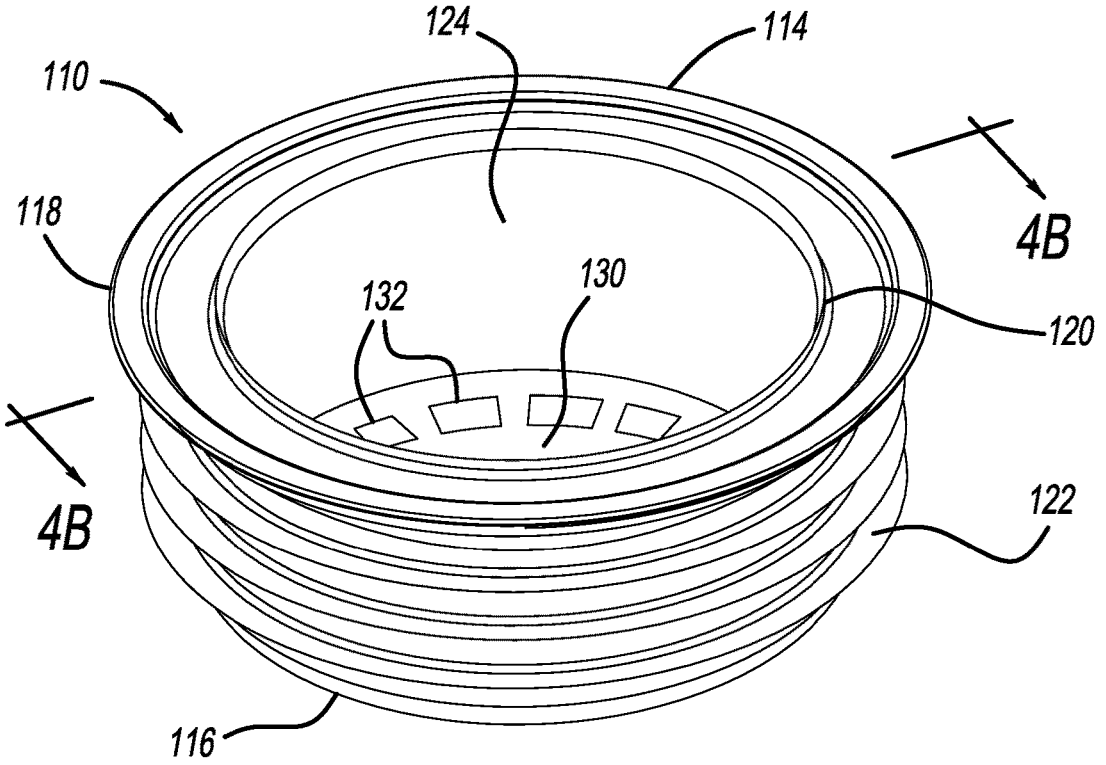
FIG. 4A is a perspective view of the insert of FIG. 2.
Figure 4B:
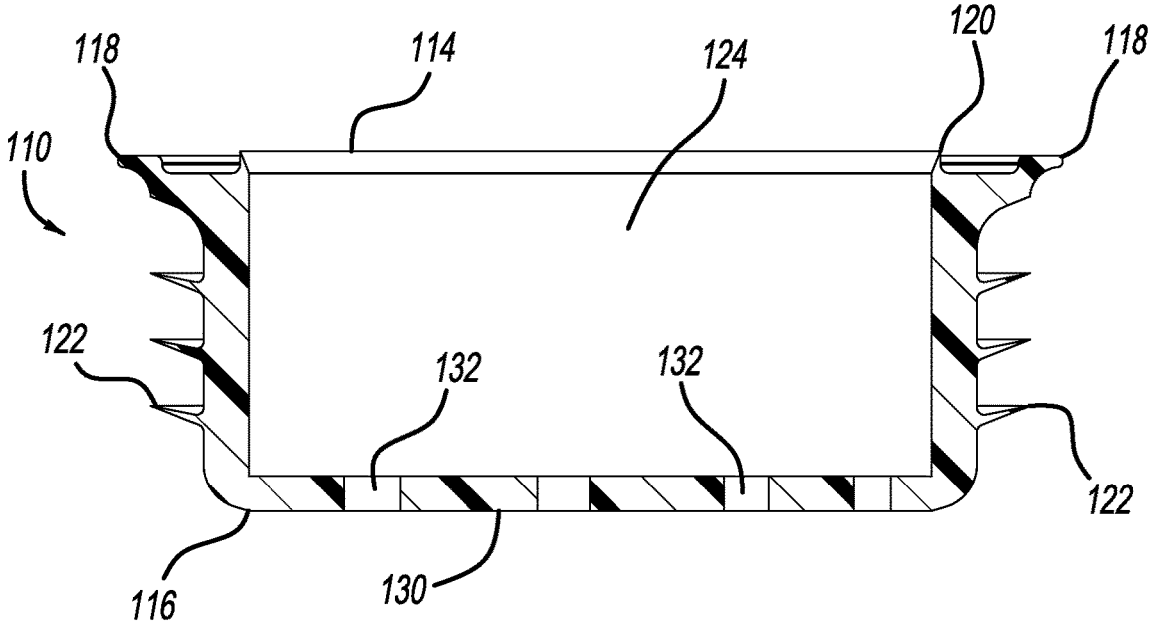
FIG. 4B is a cross-sectional view of the insert taken along line 4B-4B of FIG. 4A.

With continued reference to FIGS. 1 and 2, and additional reference to FIGS. 4A and 4B, the insert/fitment 110 will now be further described. In one embodiment, the insert 110 includes a first end 114 and a second end 116, which is opposite to the first end 114 with respect to a longitudinal axis of the insert 110 extending through an axial center of the insert 110. At the first end 114, the insert 110 includes a flange 118 generally extending outward. Inboard of the flange 118 is a lip 120, which can have any suitable shape to generally provide the insert 110 with a spout to facilitate pouring. The lip 120 can extend upward above the flange 118 to support the closure 70 above the flange 118 and to define a gap therebetween. Between the flange 118 and the second end 116 is a plurality of ribs 122 extending outward from an outer surface of the insert 110. The ribs 122 are generally flexible enough to permit insertion of the insert 110 within the opening 42 of the container 10, but rigid enough to maintain the insert 110 within the opening 42 (such as with a press fit) when the closure 70 is unscrewed from the finish 40. The insert 110 can be made of any suitable material, such as any suitable polymeric material. Exemplary polymeric materials include low-density polyethylene (LDPE), high-density polyethylene (HDPE), and polypropylene (PP).

The insert 110 further includes an inner surface 124, which is generally circular and configured to mate with an outer surface 86 of the internal flange 74 of the closure 70, such as with a press fit, in order to secure the insert 110 to the internal flange 74. The insert 110 also includes a base 130 at or proximate to the second end 116. The base 130 includes any suitable features configured to facilitate pouring of contents out from within the container 10, as well as prevent the container 10 from being refilled when the insert 110 is seated in the opening 42. For example and as illustrated in at least FIGS. 4A and 4B, the base 130 can define one or more slots 132, which are sized, shaped, and positioned in any suitable manner to facilitate pouring, such as to provide an even and controlled flow, and may be further configured to provide a metered flow so as to control the amount of liquid poured out from within the container 10, which is particularly useful for liquor bottles. In addition to, or in place of, the base 130 and the slots 132, the insert 110 can be configured with any other suitable features to facilitate pouring and restrict refilling of the container 10.

Figure 5:
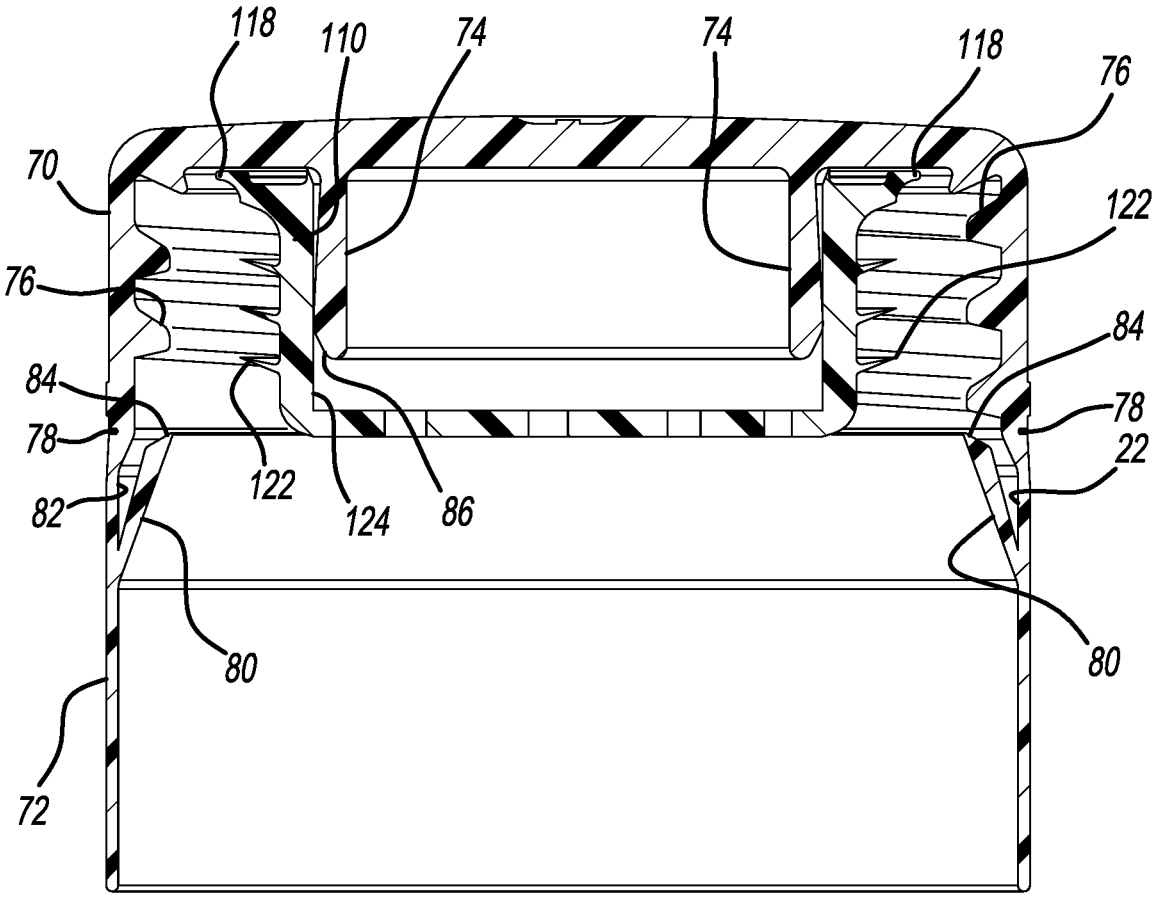
FIG. 5 is a cross-sectional view of the closure with the insert mated therewith.
Figure 6:
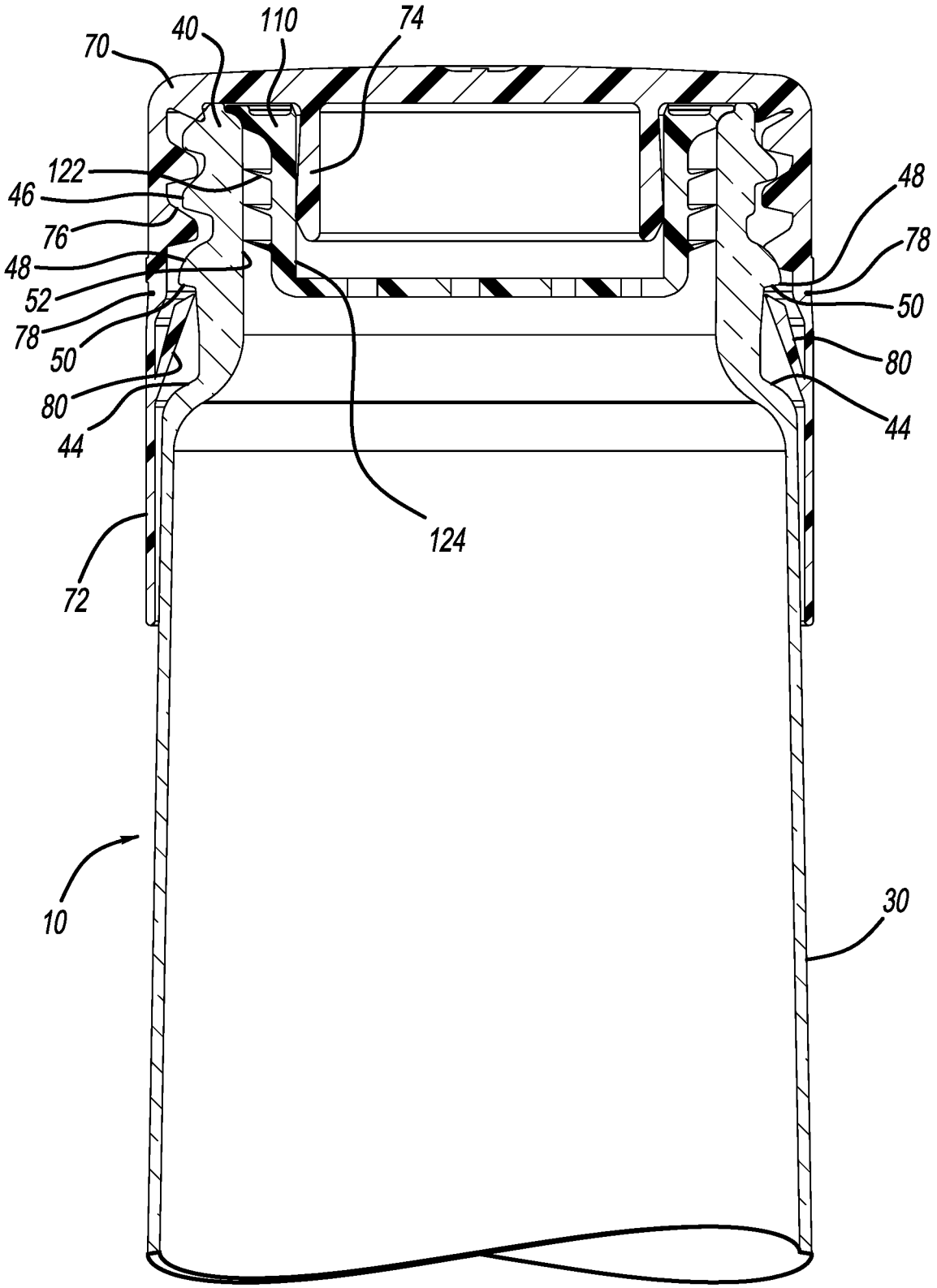
FIG. 6 is a cross-sectional view of the closure, including the insert mated therewith, coupled to the container of FIG. 1.

With reference to FIGS. 5 and 6, prior to filling the container 10, the insert 110 is coupled to the closure 70, such as by a manufacturer of the container 10, and/or of the closure 70 and insert 110. The insert 110 is coupled to the closure 70 by placing the insert 110 over the internal flange 74 of the closure 70, such that the outer surface 86 of the internal flange 74 contacts the inner surface 124 of the insert 110 in order to secure the insert 110 onto the internal flange 74 with a press fit, or in any other suitable manner. After the container 10 is filled, the closure 70 with the insert 110 coupled thereto is secured to the finish 40 in order to close the container 10. Specifically, the threads 76 of the closure 70 are threadably coupled to the threads 46 of the finish 40. With the closure 70 coupled to the finish 40 by way of the threads 46, the tamper ring 72 is seated on an exterior of the neck 30 to extend down the neck 30 to a distance based on the particular length of the tamper ring 72. The insert 110 is arranged within the finish 40 such that the ribs 122 contact an inner surface 52 of the finish 40 proximate to the opening 42, in order to secure the insert 110 within the finish 40. Because the insert 110 is coupled with the closure 70, this advantageously eliminates the need for the bottler to perform an extra step of coupling the insert 110 to the closure 70. The insert 110 is optional, and thus the closure 70 can be coupled to the finish 40 without the insert 110.

Figure 7:
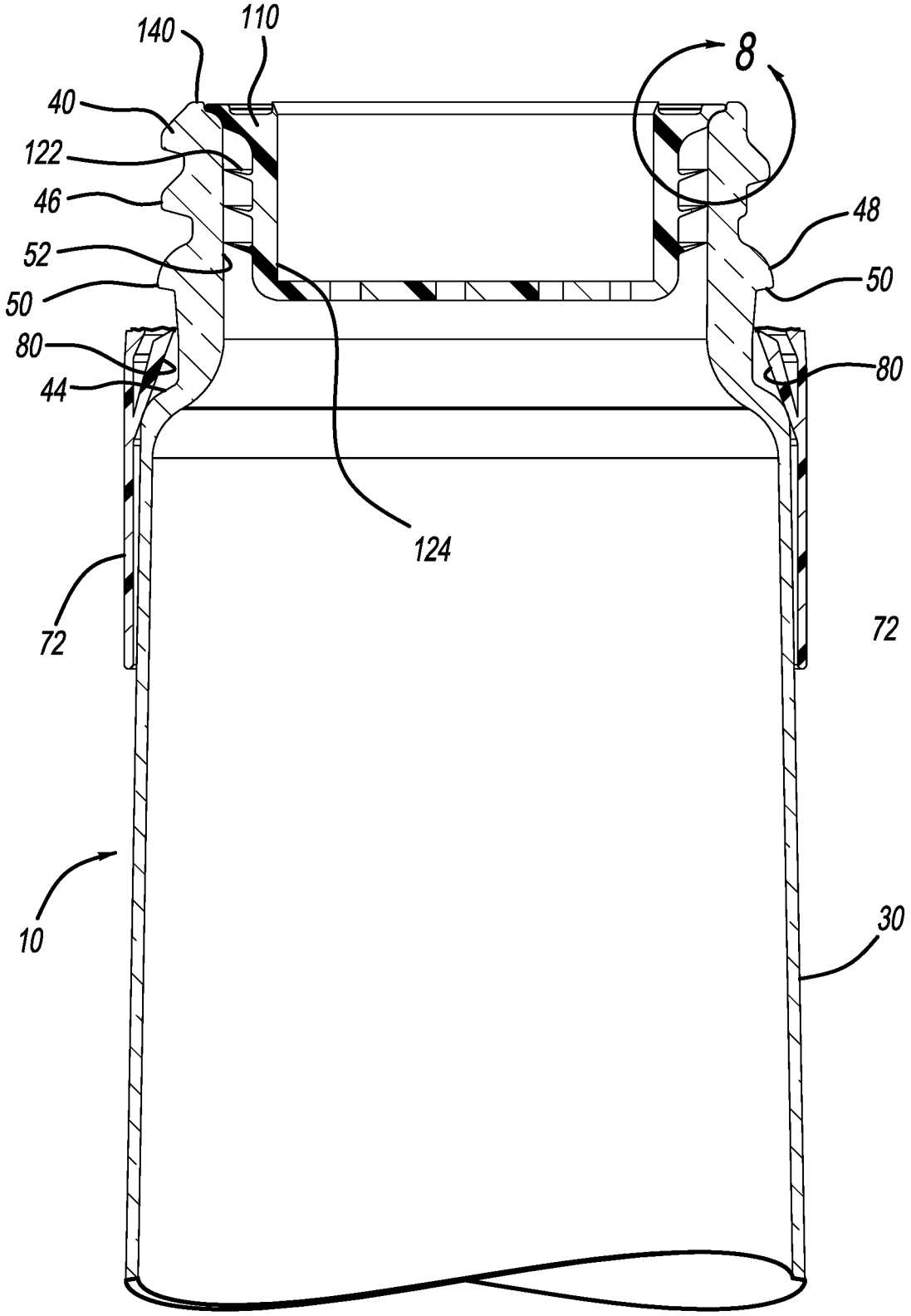
FIG. 7 is a cross-sectional view similar to FIG. 6, but with the closure removed, the insert remaining within the finish of the container, and a tamper ring decoupled from the closure.

To open the container 10, the closure 70 is twisted, thereby breaking the coupling 78 and detaching the closure 70 from the tamper ring 72. The tamper ring 72 will then typically slide down the neck 30 until the inner tab 80 contacts the ridge or flange 44, as illustrated in FIG. 7. As the closure 70 is removed, the press fit between the ribs 122 and the inner surface 52 retains the insert 110 within the finish 40. Thus the insert 110 remains in the opening 42 to facilitate pouring of contents out from within the container 10 through the slots 132 as described above, or in any other suitable manner. The insert 110 also restricts refilling of the container 10.

The tamper bead 48 facilitates separation of the tamper ring 72 and the closure 70. For example, as the closure 70 is unscrewed from the finish 40, the closure 70 will move upward and away from the first end 12 of the container 10. This will cause the tamper ring 72 to slightly rise towards the first end 12 until the inner tab 80 thereof contacts the tamper bead 48. Specifically, the distal portion 84 of the inner tab 80 will contact the generally planar surface 50 of the tamper bead 48 to restrict the tamper ring 72 from further moving towards the first end 12. As a result, the closure 70 will move further upward while the tamper ring 72 will not, thus resulting in separation of the closure 70 from the tamper ring 72 at the coupling 78.

Figure 8:
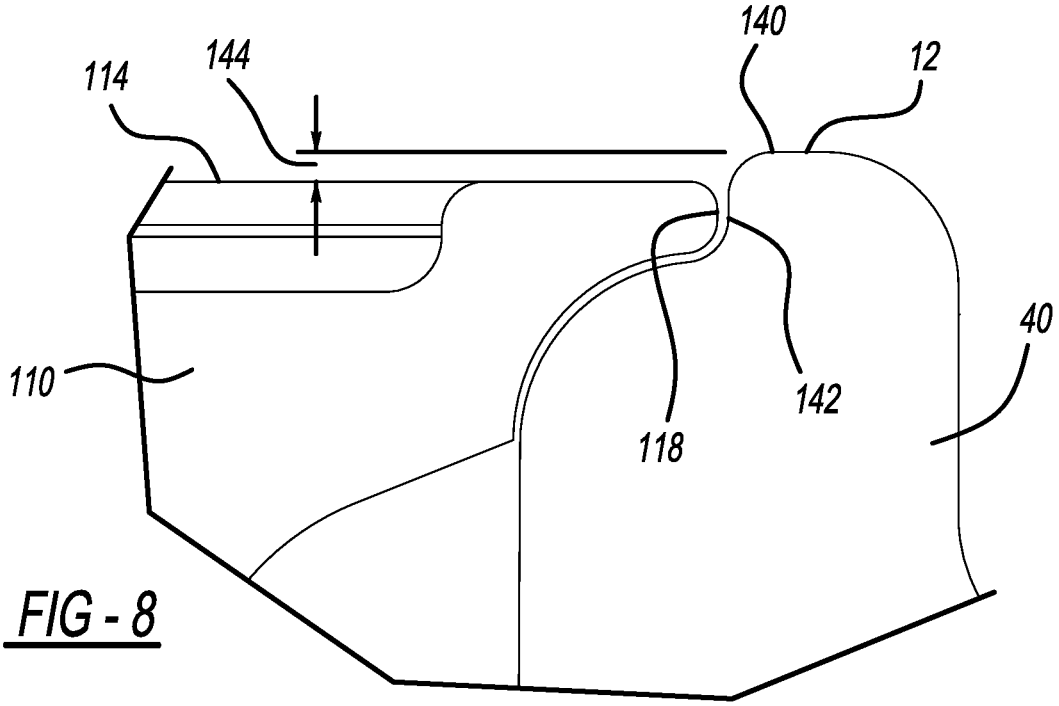
FIG. 8 illustrates the detail at Area 8 of FIG. 7.

With reference to FIG. 8, the insert 110 is positioned within the finish 40 below a top sealing surface 140 at the first end 12 of the container 10. The top sealing surface 140 contacts an inner surface of the closure 70 outboard of the internal flange 74 to advantageously provide a seal directly between the closure 70 and the container 10, which seals the contents of the container 10. To facilitate providing the seal at the top sealing surface 140, the insert 110 is seated at a stepped portion 142 of the finish 40. Specifically, the flange 118 of the insert 110 is seated on the stepped portion 142 so as to define a gap 144 between the top sealing surface 140 and the first end 114 of the insert 110. Proper sealing between the closure 70 and the top sealing surface 140 can be achieved with or without the insert 110.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A closure system for a container comprising:

a closure configured to couple with a finish of the container to close an opening of the container defined by the finish;

a tamper ring removably attached to the closure; and an insert configured to be coupled to the closure, the insert includes a first end and a second end opposite to the first end, the insert configured to control flow of liquid out from within the container, and restrict refilling of the container with liquid;

wherein upon removing the closure from cooperation with the finish of the container, the tamper ring detaches from the closure and remains on a neck of the container; and wherein the insert includes an outwardly extending flange at the first end, the flange configured to be received within a stepped recess of the container to define a gap between the first end of the insert and a top sealing surface of the finish of the container.

2. The closure system of claim 1, wherein the closure includes an internal flange configured to mate with the insert to couple the insert to the closure.

3. The closure system of claim 2, wherein the insert is configured to be placed over the internal flange of the closure to couple the insert to the closure with a press-fit.

4. The closure system of claim 1, wherein the insert includes at least one retention feature extending from an outer surface of the insert, the at least one retention feature is configured to retain the insert within the finish of the container after the closure is removed from the container.

5. The closure system of claim 4, wherein the at least one retention feature includes a plurality of retention ribs configured to contact an inner surface of the finish when the insert is seated within the finish to retain the insert within the finish with a press-fit after the closure is removed from the container.

6. The closure system of claim 1, wherein the insert includes a base at the second end defining a plurality of slots configured to control flow of liquid out from within the container, and restrict refilling of the container with liquid.

7. The closure system of claim 1, wherein the tamper ring includes an inner tab configured to contact a tamper bead extending from the finish to prevent the tamper ring from being pulled over the finish as the closure is unscrewed from the finish.

8. The closure system of claim 7, wherein the tamper bead is between threads of the finish and a neck of the container.

9. The closure system of claim 1, wherein upon coupling the closure to the finish with the insert attached to the closure, the insert is secured within the opening of the container with a press-fit; and wherein upon subsequent decoupling of the closure from the finish the closure detaches from the insert and the insert remains secured within the opening of the container with the press-fit.

10. The closure system of claim 9, wherein upon the subsequent decoupling of the closure from the finish the closure detaches from the tamper ring and the tamper ring remains on a neck of the container.

11. The closure system of claim 10, wherein contact between an inner tab of the tamper ring and a tamper bead of the finish prevents the tamper ring from being lifted over the finish.

12. The closure system of claim 1, wherein the tamper ring is selected from a plurality of tamper rings of different lengths.

13. The closure system of claim 1, wherein the container is made of one of glass or polyethylene terephthalate.

14. The closure system of claim 1, wherein the closure is made of one of polyethylene terephthalate or high-density polyethylene.

15. The closure system of claim 1, wherein the insert is made of one of low-density polyethylene (LDPE), high-density polyethylene (HDPE), and polypropylene (PP).

16. The closure system of claim 1, wherein the finish includes a tamper bead between threads of the finish and a neck of the container; wherein the finish is formed by injection molding or blow molding.

17. The closure system of claim 1, wherein the container is configured to be blow molded from a preform.

18. The closure system of claim 1, wherein the container is a wine bottle.

19. The closure system of claim 1, wherein the container is a spirits bottle.

20. The closure system of claim 1, wherein upon coupling the closure with the insert mounted thereto to the finish of the container, the insert is recessed beneath a top sealing surface of the container where a seal is formed between the top sealing surface of the container and the closure.

21. A closure system for a container comprising:

a closure configured to couple with a finish of the container to close an opening of the container defined by the finish;

a tamper ring removably attached to the closure; and an insert configured to be coupled to the closure, the insert includes a first end and a second end opposite to the first end, the insert configured to control flow of liquid out from within the container, and restrict refilling of the container with liquid;

wherein upon removing the closure from cooperation with the finish of the container, the tamper ring detaches from the closure and remains on a neck of the container; and wherein upon coupling the closure with the insert mounted thereto to the finish of the container, the insert is recessed beneath a top sealing surface of the container where a seal is formed between the top sealing surface of the container and the closure.

* * * * *